US007156482B2

(12) United States Patent
Boleda et al.

(10) Patent No.: US 7,156,482 B2
(45) Date of Patent: Jan. 2, 2007

(54) PRINTHEAD-TO-PLATEN SPACING VARIATION ALONG SCAN AXIS DUE TO CARRIAGE GUIDE, MEASURED BY SIMPLE SENSOR ON CARRIAGE

(75) Inventors: Miquel Boleda, Barcelona (ES); Michel Encrenaz, Barcelona (ES); James L McCullough, San Diego, CA (US); Jorge Castano, Barcelona (ES)

(73) Assignee: Hewlett Packard Development Company, L. P., Houston, TX (US)

( * ) Notice: Subject to any disclaimer, the term of this patent is extended or adjusted under 35 U.S.C. 154(b) by 27 days.

(21) Appl. No.: 09/942,070

(22) Filed: Aug. 28, 2001

(65) Prior Publication Data

US 2004/0217999 A1 Nov. 4, 2004

(51) Int. Cl.
*B41J 2/045* (2006.01)

(52) U.S. Cl. ..... 347/19; 347/14

(58) Field of Classification Search ..... 347/5, 347/8, 14, 19, 37, 39; 400/55, 58
See application file for complete search history.

(56) References Cited

U.S. PATENT DOCUMENTS 5,576,744 A 11/1996 Niikura et al.
5,796,414 A 8/1998 Sievert et al.
6,290,319 B1 * 9/2001 Boleda et al. ..... 347/19
6,832,824 B1 12/2004 Baker et al.
7,023,581 B1 4/2006 Soler et al.

FOREIGN PATENT DOCUMENTS

| | | | | |
|---|---|---|---|---|
| EP | 0031421 | * | 8/1981 | |
| EP | 0 925 928 | | 6/1999 | |
| EP | 1 029 673 | | 8/2000 | |
| EP | 1 029 698 | | 8/2000 | |
| JP | 02-011374 | * | 1/1990 | ..... 400/58 |
| JP | 08 080655 | | 3/1996 | |
| JP | 09-029958 | * | 2/1997 | |

* cited by examiner

*Primary Examiner*—Huan Tran
(74) *Attorney, Agent, or Firm*—Peter I. Lippman

(57) ABSTRACT

PPS variation along a scan axis is found by shining a light beam from pen carriage to print-medium position and back to detector, and applying a pathlength/intensity correlation. Sensing is done while scanning, to find relative PPS profile along the track. With no medium in place this measures mechanical imperfections—and can be corrected by later deducting thickness of a medium. If medium is present, adjustment is omitted. For absolute values a plural-lamp sensor is calibrated for each lamp, at the PPS design point. Pagewide/webwide variants are included.

21 Claims, 5 Drawing Sheets

12
13
13'
13''
17
~CARRG.~
21
I-CHANNEL DET.
20
COMMON LED
PRT.-HEAD
11
15
29
$\theta_4$
23
22
$\theta_1$
$\theta_2$
$\theta_3$
24
25
26
14'
14
$d_1$
$d_2$ 12
17
21
I-CHANNEL DET.
29'
20
COMMON LED
HEAD
11
PPS
$\theta_4$
$\theta_1$
23
22
34
33
32
31
16
16'
14'
14
$d_3$
$d_4$
t

PRINTHEAD-TO-PLATEN SPACING VARIATION ALONG SCAN AXIS DUE TO CARRIAGE GUIDE, MEASURED BY SIMPLE SENSOR ON CARRIAGE

RELATED PATENT DOCUMENTS

Closely related documents are other, coowned utility-patents or applications, hereby wholly incorporated by reference into this document. One is in the names of Miquel Boleda et al., titled "CONTROLLING RESIDUAL FINE ERRORS OF DOT PLACEMENT IN AN INCREMENTAL PRINTER"—filed in the United States Patent and Trademark Office as Ser. No. 09/253,494, and issued as U. S. Pat. No. 6,290,319; others include an application of Soler et al., "COMPENSATING FOR DRIFT AND SENSOR PROXIMITY IN A SCANNING SENSOR, IN COLOR CALIBRATING INCREMENTAL PRINTERS", U. S. Ser. No. 09/919,260, later issued as U.S. 7,023,581; and another in the names of Thomas H. Baker et al., Ser. No. 09/183,819, "COLOR-CALIBRATION SENSOR SYSTEM FOR INCREMENTAL PRINTING" issued as U.S. Pat. No. 5. 6,832,824; and a patent of Sievert et al., "SYSTEMS AND METHOD FOR ESTABLISHING POSITIONAL ACCURACY IN TWO DIMENSIONS BASED ON A SENSOR SCAN IN ONE DIMENSION", U.S. Pat. No. 5. 5,796,414. Still another is in the names of Boleda et al., "A CORRECTION SYSTEM FOR DROPLET PLACEMENT ERRORS IN THE SCAN AXIS, IN . . . INKJET PRINTERS", European Publication 1029673.

Another patent document of interest, also wholly incorporated by reference, is U.S. Pat. No. 5,576,744 to Niikura et al. (Canon), "RECORDING APPARATUS AND METHOD COMPENSATING FOR VARYING GAP BETWEEN RECORDING HEAD AND RECORDING MEDIUM".

FIELD OF THE INVENTION

This invention relates generally to machines and procedures for incremental printing of images (which may include text), and more particularly to a scanning-printhead machine and method that construct such images from individual colorant spots created on a printing medium. The invention corrects small, systematic errors in colorant-spot placement that are important in regard to coordination of marks made by different printheads—e.g. in different colors. In some special cases these errors are also significant as to absolute positioning.

The problem solved by the invention, and also the invention itself, will be discussed primarily in terms of thermal-inkjet printing. A person skilled in the art, however, will appreciate that both are applicable to certain other types of incremental printers.

BACKGROUND OF THE INVENTION (a) Misregistration scan-axis variation—As shown in the Boleda patent documents listed above, image-registration problems can arise from an imperfection in carriage guide mechanisms that cause registration to vary reproducibly along the printhead scan axis. Detecting and measuring these imperfections is the focus of the present document.

The Boleda documents taught that tiny nonlinearities in guide bars, followers, and other components caused minute printhead rotations—leading to errors in registration. Boleda also showed that these errors could be detected by printing and analyzing a test pattern, and compensated by selectively tuning the relative timing of mark generation along different segments, respectively, of the scan path.

Boleda's analysis employed an already-onboard line sensor, provided on the printhead carriage for use in interhead alignment. He commandeered that sensor into further service to detect expansions and compressions of the test pattern, varying along the printer scan axis—due to the above-mentioned mechanism imperfections and resulting fine rotations.

Misregistrations of the sort under consideration—i.e., due to PPS phenomena—can appear as between colors, and also for the same color as between marks made while scanning in opposite directions, and furthermore even for the same direction and color as among marks made while scanning at different speeds. Errors also can arise as combinations of these effects.

Mechanical imperfections leading to such misregistrations can in turn arise as imperfect straightness in a guide rod itself, or imperfect planarity or cylindricity of a platen or the like which establishes the nominal printing-medium position, or imperfect parallelism between the rod and the print-medium position. Typically a guide mechanism itself has plural members, and imperfect geometries between or among those can produce a twisted form of error that is sometimes of one sense and at other times of opposite sense. Imperfections also can arise as combinations of all these effects.

The Niikura document, too, mentions mechanism problems leading to registration variations, but those variations run perpendicular to the scan axis. In his brief discussion of scan-axis variations, Niikura is concerned only with another misregistration source (printing-medium curl) that is not of interest here. Niikura thus suggested no connection between his compensation for scan-axis variations and any built-in hardware errors.

In addition, to the extent that Niikura investigated any registration variations along the scanning axis, his principal method of assessing such variations relied upon very expensive acquisition of electronic images of preprinted hardcopy regions—using a charge-coupled detector ("CCD"), and then computation-intensive processing to compare halftone dot sizes or spacings.

A typical CCD, as is well known, is an expensive multipixel device that yields an actual image of the preprinted hardcopy region; and Niikura's acquired image is very greatly enlarged to permit extremely fine analysis of minute image details. (Other Niikura teachings involving a "laser sensor", for variation transverse to the scan axis, are ambiguous as to both the character of the sensor and methodology of its use; possibly it was interferometric.)

(b) Measurement methods and their drawbacks—Boleda—and also Niikura, in dealing with registration fluctuations along the scan axis—depended upon analysis of some information premarked on the printing medium. Boleda used a simple and essentially free device already present in the printer; Niikura used the above-mentioned CCD—a relatively very costly device—and also elaborate, sophisticated postprocessing.

Each of these earlier systems has its respective definite limitations. The Boleda approach requires preprinting on the print medium something that would not otherwise be printed—and this consumes medium, ink, and time. Niikura's approach for scanwise error (due to cockle) minimizes this drawback by scanning a previously printed portion of an in-progress hardcopy; but his analysis stage requires expensive componentry and heavy computation.

What is desired is some way to measure departures from uniform printhead-to-print-medium spacing without printing, without special equipment, and without significant signal processing. Heretofore no such way has appeared in the art.

(c) Factory PPS determination—The Boleda patent document first-mentioned above shows how rectilinearity of a carriage guide bar can be evaluated through printing and analysis of a test pattern. Entirely apart from the cost, delay and inconvenience of generating the test pattern to obtain these relative measurements all along the scan axis, another severe prior-art limitation is the difficulty of obtaining an absolute value of PPS at even any single point in the path.

Such an absolute measurement, at least at some single point, is an additional piece of data requisite to trustworthy PPS calibration. Heretofore such a measurement has been possible only through positioning some special measuring fixture in the printer, or a special jig next to the printer, to perform an actual primary determination.

After this determination has been completed, furthermore, the jig or fixture must then be removed carefully to ensure its continuing good condition for further accurate measurements of other printers. These factory equipments and operations add up to a significant and undesirable manufacturing cost and complication.

(d) Machine printing formats: scanning-head and pagewide-array, and equivalents—The documents mentioned above deal with printers in which relatively small marking heads ("printheads"), whose length is only a fraction of the height of the desired image, are mounted on scanning carriages that traverse the width of a desired image area. Marking is accomplished by operating the heads during such scanning, to form a swath of marks; then the printing medium is advanced in the orthogonal direction, to position the medium relative to the head for forming the subsequent swath.

Another type of system that suffers misregistration arising from PPS variation is a so-called "pagewide array" printer. In this type of machine, an array of marking elements (for each color respectively) extends across the entire image-area width; this array prints an entire line while the printing medium is advanced in the orthogonal direction—thereby forming an entire image in (most typically) a single pass of the medium through the printer.

The term "pagewide array" arises from the initial use of such systems to print on small-format sheets such as, for instance, A4 pages or 8½×11-inch pages. Equivalent operation is of interest in large-format printers, but these perhaps may not be properly denominated "pagewide"—since many of these large-format machines are loaded with rolls of paper rather than page-size sheets.

Naturally in such pagewide-equivalent units a sheet is eventually formed when a length of the roll is cut off after printing. The PPS-variation problem is a major concern in pagewide-array machines—and their large-format equivalents just discussed—as well as in scanning-head printers.

(e) Conclusion—Relatively cumbersome, expensive or slow strategies for measuring scanwise-varying misregistration due to mechanism imperfection have continued to impede achievement of uniformly excellent and rapid ink-jet printing. Thus important aspects of the technology used in the field of the invention remain amenable to useful refinement.

SUMMARY OF THE DISCLOSURE

The present invention introduces such refinement. In its preferred embodiments, the present invention has several aspects or facets that can be used independently, although they are preferably employed together to optimize their benefits.

In preferred embodiments of a first of its facets or aspects, the invention is apparatus for printing images on a printing medium, by construction from individual marks. The apparatus includes a platen locating the medium.

In certain of the appended claims, the bodies of the claims refer to the medium as "such medium". In the accompanying apparatus claims generally the term "such" is used (instead of "said" or "the") in the bodies of the claims, when reciting elements of the claimed invention, for referring back to features which are introduced in preamble as part of the context or environment of the claimed invention. The purpose of this convention is to aid in more distinctly and emphatically pointing out which features are elements of the claimed invention, and which are parts of its context—and thereby to more particularly claim the invention.

The apparatus also includes at least one printhead marking on the medium, and a carriage holding the head, and also a rod supporting the carriage for scanning motion across the medium. The apparatus also includes a sensor, at least partially mounted to the carriage, measuring relative distances between the sensor and the platen or the medium.

The sensor includes first processor portions for interpreting intensity of reflected radiation, at each of plural positions along the scanning motion respectively, as a measure of respective transmission distances from the source to the sensor. Those distances extend, between the two, via reflection from the platen or the medium.

The apparatus also includes second microprocessor portions for modifying the marking by the head. This modifying has the objective of compensating for variation of the measured distances during the scanning motion.

The foregoing may represent a description or definition of the first aspect or facet of the invention in its broadest or most general form. Even as couched in these broad terms, however, it can be seen that this facet of the invention importantly advances the art.

In particular, according to this facet of the invention the sensor simply responds to common intensity variations arising straightforwardly from the transmission distance—rather than requiring costly image recording, dissection and analysis as in Niikura's scan-axis variant (or even a "laser sensor" as in his printhead-axis system). This much more elementary sensing mode can therefore be achieved with the same inexpensive line sensor used before by Boleda, but with no need for his printing of a test pattern.

Although the first major aspect of the invention thus significantly advances the art, nevertheless to optimize enjoyment of its benefits preferably the invention is practiced in conjunction with certain additional features or characteristics. In particular, preferably the sensor further includes a radiation source emitting radiation toward the medium or the platen, and a detector receiving source radiation reflected from the medium or the platen. In this case it is further preferred that the emitted radiation be substantially incoherent, and that the sensor be a single-channel device (i.e., not a multichannel unit capable of imaging).

Another preference is that the sensor include some means for measuring the relative distances without printing on the medium. In another preference, the sensor includes some means for measuring the relative distances at multiple positions substantially along the length of the rod. The nature of these means will be clear from the detailed discussion that follows.

In yet another preference, the modifying means include memory, storing the respective transmission-distance measures for the plural positions, and also third microprocessor portions for retrieving the transmission-distance measures for the plural positions. These retrieved distance values are to use in compensation, by the second processor portions, for corresponding positions along the rod respectively.

In still another basic preference, the second microprocessor portions are any one (or more) of these:

- microprocessor portions for modifying signals from an encoder that reports position or speed, or both, of the carriage along the rod, to compensate for the distance variations;
- microprocessor portions for controlling position or speed, or both, of the carriage along the rod to compensate for the distance variations;
- microprocessor portions for controlling timing of actuation of the marking by the head, to compensate for the distance variations;
- microprocessor portions for controlling velocity of propagation of the marking from the printhead toward the medium, to compensate for the distance variations;
- microprocessor portions for adjusting position specifications in image data to compensate for the distance variations;
- microprocessor portions for adjusting positional relationships between color planes in image data, to compensate for the distance variations; or microprocessor portions for modifying pixel structure of image data, to compensate for the distance variations.

In preferred embodiments of its second major independent facet or aspect, the invention is a method of compensating operation of a printer. The printer has printheads carried on a scanning carriage next to a printing-medium position.

The method includes the step of scanning a surface substantially at the printing-medium position using a single-channel optical sensor operating with substantially incoherent light. The method also includes the step of applying a signal from the sensor to compute a printhead to-printing-medium spacing (PPS) profile along the scanning path.

This computation uses a known correlation function. The method also includes the step of adjusting marking positions of the printheads, based on the computed PPS profile.

The foregoing may represent a description or definition of the second aspect or facet of the invention in its broadest or most general form. Even as couched in these broad terms, however, it can be seen that this facet of the invention importantly advances the art.

In particular, this facet of the invention explicitly incorporates only a single-channel sensor, not a multipixel device such as the CCD used by Niikura to analyze PPS variation along the scan axis. (Furthermore this aspect of the invention expressly operates on incoherent light, requiring no laser device such as suggested by Niikura for measurement along the printhead axis.) Accordingly this aspect of the invention is far more economical in optical hardware—and also presents a vastly simpler data-processing effort after the optical hardware has done its job.

Although the second major aspect of the invention thus significantly advances the art, nevertheless to optimize enjoyment of its benefits preferably the invention is practiced in conjunction with certain additional features or characteristics. In particular, preferably the method further includes the step of loading unprinted, i.e. bare printing medium into the printer; and the surface-scanning includes scanning the unprinted, bare medium.

In preferred embodiments of its third major independent facet or aspect, the invention is a method of calibrating a printer. The printer has printheads carried on a scanning carriage next to a printing-medium position, and has a carriage support-and-guide rod subject to imperfection in geometrical relationship with the printing-medium position.

The method includes the step of projecting radiation from the carriage toward the printing-medium position for reflection back toward the carriage, at plural locations of the carriage along the rod. It also includes the step of measuring intensity variations of reflected radiation received on the carriage at the plural locations.

Another included step is interpreting the intensity variations as directly due to attenuation in travel of the radiation through the distance from the carriage toward the printing-medium position—and then back to the carriage. Yet another step is retaining the interpreted intensity-variation information for use in compensating the imperfection.

The foregoing may represent a description or definition of the third aspect or facet of the invention in its broadest or most general form. Even as couched in these broad terms, however, it can be seen that this facet of the invention importantly advances the art.

In particular, this method facet of the invention is closely related to the first, apparatus, facet. Accordingly this form of the invention shares the benefits of that first aspect.

Although the third major aspect of the invention thus significantly advances the art, nevertheless to optimize enjoyment of its benefits preferably the invention is practiced in conjunction with certain additional features or characteristics. In particular, preferably the projecting step includes projecting the radiation to a printing medium disposed at the printing-medium position; and the measuring step includes receiving the radiation reflected from the printing medium—while the attenuation is due to scattering of the radiation in the reflection, and divergence of the radiation during the travel.

In case this preference is observed, then a further sub-preference is that during the projecting and receiving, substantially nothing has been printed on the printing medium—so that the printing medium is substantially bare printing medium.

Another basic preference, as to the third major aspect under discussion, is that the projecting step include projecting the radiation to a platen disposed substantially at the printing-medium position; and the measuring step include receiving the radiation reflected from the platen. In this case it is further preferred that the interpreting step include making a distance allowance for thickness of printing medium absent from the platen.

Yet another basic preference, still as to the third major aspect, is that the interpreting step include referring to a previously determined correlation function. More specifically, that is a relationship between intensity-variation information and printhead-to-printing-medium spacing.

In preferred embodiments of its fourth major independent facet or aspect, the invention is a method of determining printhead-to-printing-medium spacing (PPS) in an incremental printer, using a plural-lamp sensor. This method includes the step of defining a design value for PPS in the printer.

It also includes the steps of calibrating the sensor, with each lamp of the plurality respectively, at the design PPS value; and installing the calibrated sensor in the printer.

Another step is operating the sensor, with each lamp of the plurality respectively. This step is performed in such a way as to develop a sensor output signal representing at least one difference between PPS measurements with a corresponding pair of the lamps.

Yet another step is interpreting the at least one difference signal as a PPS displacement from the design PPS value. This step operates to determine actual PPS in the printer.

The foregoing may represent a description or definition of the fourth aspect or facet of the invention in its broadest or most general form. Even as couched in these broad terms, however, it can be seen that this facet of the invention importantly advances the art.

In particular, this aspect addresses the previously discussed expense and awkwardness, or inaccuracy, of factory calibration. Use of this facet of the invention provides—quickly, easily, and automatically—an accurate absolute PPS measurement, straightforwardly extended to measurements all along the scan axis if desired.

There is no need for installing (and then removing) any special measuring jig or fixture in the printer. This facet of the invention accordingly solves a significant earlier-mentioned problem in the art.

Although the fourth major aspect of the invention thus significantly advances the art, nevertheless to optimize enjoyment of its benefits preferably the invention is practiced in conjunction with certain additional features or characteristics. In particular, preferably the operating step includes using the sensor with the pair of lamps in alternation to develop an a. c. signal output representing the at least one difference.

Another basic preference is that the operating step further include using the sensor with another pair of lamps in alternation—to develop another a. c. signal output representing another difference—and that the interpreting step include computing a mean of the differences. It will be appreciated that this mean need not be a simple arithmetic average; thus for instance advantageously the computing may include weighting the differences in an inverse relation to signal noise associated with each difference; or the computing may include finding the mean as a root-mean-square of the weighted differences; or, equivalently, more than two pairs of lamps may be operated in like manner and their respective a. c. signals combined in some comparably rapid and simple way to derive a more reliable or precise overall value.

In preferred embodiments of its fifth major independent facet or aspect, the invention is apparatus for printing an image on a printing medium, by construction from individual marks. The apparatus includes a platen locating the medium, and also an array of printing elements marking on the medium; the array is of length at least as great as the width of the image.

Also included is an advance mechanism providing relative motion of the medium and the array, substantially at right angles to the array length. The apparatus further includes a carriage scanning lengthwise along the array.

In addition the apparatus includes a sensor. The sensor is at least partially mounted to the carriage, and measures relative distances between the sensor and the platen or medium.

The sensor includes first processor portions interpreting intensity of reflected radiation—at each of plural positions along the scanning motion respectively—as a measure of respective transmission distances. These are distances from the source to the sensor via reflection from the platen or medium.

Also included are second microprocessor portions that modify the marking by the array. These portions modify the marking to compensate for variation of the measured distances along the array length.

The foregoing may represent a description or definition of the fifth aspect or facet of the invention in its broadest or most general form. Even as couched in these broad terms, however, it can be seen that this facet of the invention importantly advances the art.

In particular, this aspect of the invention resolves the PPS problem for pagewide-array devices—or their equivalent in pageless large-format systems. Based on this aspect of the invention, misregistration and other manifestations of PPS variation are straightforwardly brought under control.

Although the fifth major aspect of the invention thus significantly advances the art, nevertheless to optimize enjoyment of its benefits preferably the invention is practiced in conjunction with certain additional features or characteristics. In particular, preferably the carriage carries exclusively the sensor or portions thereof, not the array.

All of the foregoing operational principles and advantages of the present invention will be more fully appreciated upon consideration of the following detailed description, with reference to the appended drawings, of which:

DETAILED DESCRIPTION OF THE PREFERRED EMBODIMENTS

1. Relationships Between P. P. S. and Mark Placement

Preferred embodiments of the invention enable application of a compensation for varying printhead-to-print-medium distance along the scan axis, without printing any diagnostic pattern at all. The earlier-mentioned patent documents show how quality in an inkjet printout is affected by accuracy with which the printer controls the position where inkdrops land on the paper or other printing medium.

Figure 1:
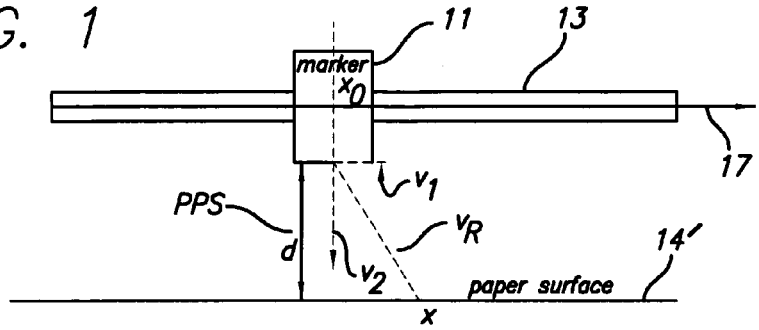
FIG. 1 is a elevational diagram, highly conceptual and taken longitudinally along the scanning axis of a printer system, showing how PPS and scanning motion interact to affect mark placement.

A brief review of this relationship is offered here. In current inkjet printers, a marker or "printhead" moves 17 (FIG. 1) forward along a scan axis at velocity $v_1$ while ejecting drops—nominally from a position $x_0$—at velocity $v_2$ normal to the scanning motion. Since the ejection velocity is less than infinite and the distance D (or PPS) to the surface 14' of the medium greater than zero, however, the drops do not impinge upon the medium at the same point $x_1$ where they are ejected.

Instead the drops have forward momentum due to the initial forward movement of the ink in the ejection chamber, at the same forward velocity $v_1$ as the marker. For simplicity neglecting second-order effects, particularly aerodynamic interaction of the drops with air along the way to the print-medium surface 14', the drops assume a resultant velocity $v_R$ along an angled path—forward and downward toward the surface 14'.

The landing position of a single drop can be deduced from the relation:

$$x=x_0+D\cdot v_1/v_2$$

and the offset Δx between the firing and landing positions is $$\Delta x=x-x_0=D\cdot v_1/v_2.$$

For a given marker, with scan speed $v_1$ and fixed ejection velocity $v_2$, the landing position thus depends on the distance D or PPS between the marker and the sheet—and also on the ratio of velocities $v_1/v_2$, which may be termed the "velocity offset ratio" (VOR).

An estimate of the small misregistration magnitude d(Δx) that arises in response to uncontrolled variation dD in the PPS is therefore:

$$d(\Delta x)=d(x-x_0)=dD\cdot v_1/v_2.$$

In determining misregistration magnitude the VOR thus behaves as a sort of scaling factor to the PPS variation dD. Under unfavorable operating conditions—rapid scanning (high $v_1$) and relatively sluggish ejection (low $v_2$)—the VOR is high and distinctly amplifies the PPS variation; and conversely.

If aerodynamic and other second-order effects are taken into account, the calculated magnitude of the positional error is different. In general, however, the error remains an increasing function of the PPS and the VOR.

The velocities $v_1$, $v_2$ are both subject to control, as are many other image-formation process parameters enumerated in the earlier discussion of preferences for the second major aspect of the invention. All of these controllable variabilities can be pressed into service for compensation of the relatively uncontrollable variability of the PPS distance d.

Typical scan velocities $v_1$ are from roughly 0.4 to 1.3 m/sec (15 to 50 ips). This applies to the relative velocities in so-called "pagewide" and equivalent devices as well as to scanning-carriage systems.

Typical inkjet ejection velocities $v_2$ are 10 to 15 m/sec (400 to 600 ips); hence $v_1/v_2$ ranges very roughly from 1/40 to 1/8. The pen-to-print-medium spacing PPS itself is typically D=1.1 to 1.6 mm; and the PPS variations under consideration here is dD=0.3 to 0.5 mm.

Placement error due to such variation dD is therefore as high as $d(\Delta x)=dD\cdot v_1/v_2=0.5\ \text{mm}\cdot 1/8=0.063$ mm in the worst case of high VOR (high scan speed divided by low drop-ejection speed)—or $0.5\ \text{mm}\cdot 1/40=0.013$ mm in the most-forgiving, low-VOR case. These values are doubled for misregistration as between opposed-direction scans in bidirectional printing—to roughly 0.13 mm or 0.03 mm respectively.

The implication of these values in a 24 dot/mm (600 dpi) pixel grid is significant. Error in the worst speedratio case is 0.063 mm·24 dot/mm=1.6 pixel for unidirectional printing, 0.13 mm·24 dot/mm=3 pixels for bi-directional printing.

PPS distance D varies along the scan path because of printhead 11 rotation due to imperfect straightness in the guide rod 13, imperfect cylindricity or planarity of the nominal printing-medium position, or imperfect parallelism with that medium position—as well as twisting effects mentioned earlier. (Incidentally to the present invention, it also varies on account of paper deformation as noted by Niikura.)

Because of such variation in the distance d, the landing point x and its offset Δx that can be deduced from any single-point alignment procedure—such as the Boleda patent document on alignment introduces—is in general not accurate for the rest of the positions. To compensate for this effect, heretofore another calibration is performed following the procedure shown at left below.

| | related art | | present invention |
|---|---|---|---|
| 1 | load paper | 1 | load paper |
| 2 | print test pattern | | |
| 3 | reposition paper | | |
| 4 | scan the pattern | 2 | scan bare paper |
| 5 | deduce d profile | 3 | deduce d profile |

Once the profile is found, the procedure continues to find the compensation as a function of pen position x, and store that function. Then during printing the system adjusts the firing position dynamically for all positions x.

2. Streamlined Procedure with Nonprinting Measurement

The tabulation above also shows, at right, the very straightforward simplifications available through use of the present invention. Those simplifications begin with omission of steps 2 and 3 entirely, and continue in subtle differences between the scanning and deducing steps.

The kinds of information collected in the course of the scan step, and the ways in which that information are used to deduce the distance profile, differ. As will be seen, that information—and those procedures for deducing the profile—are simpler and faster in the present invention than in the related-art procedures.

Another important improvement is that the scanning on bare paper (step 2 in the right-hand tabulation above) can be combined with any one of various other scan procedures. Merely as examples, such other procedures may include pen-to-pen alignment scans such as taught by the previously mentioned Sievert document, or even other bare-paper scans such as the media-point sensor-calibration scans taught by the Soler document.

Figure 3:
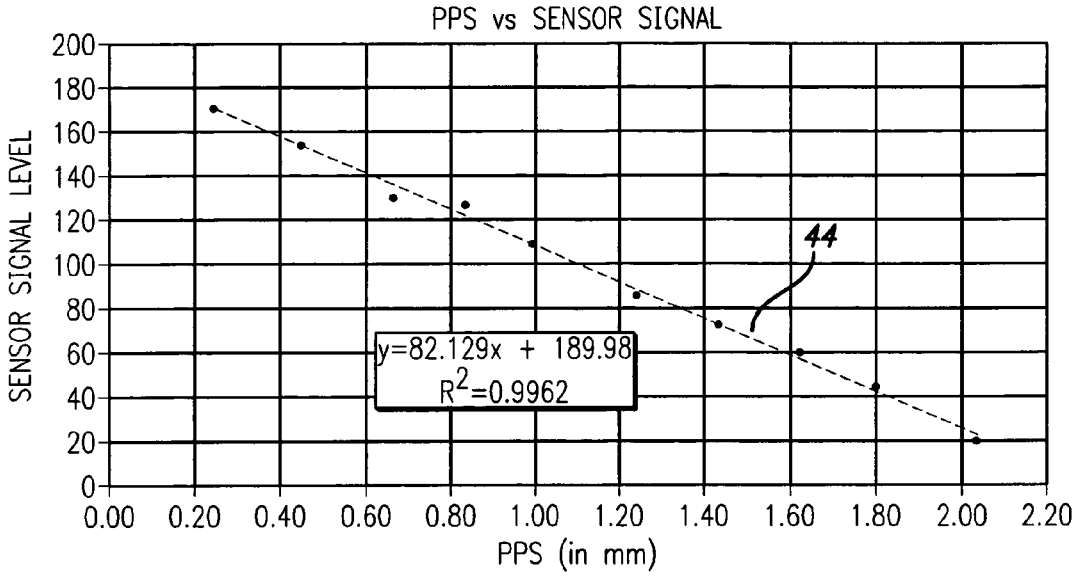
FIG. 3 is a graph of an experimentally determined correlation function that interrelates sensor signal with PPS.

In routine operation, the simplified procedure of the present invention requires resort to a known correlation between PPS and sensor signal. Such a correlation function 44 (FIGS. 3 and 6) is most typically determined in advance of routine operation—e.g. at the factory—and stored in a system memory 43 (FIG. 6) together with information 41 from the bare-paper scan.

Figure 6:
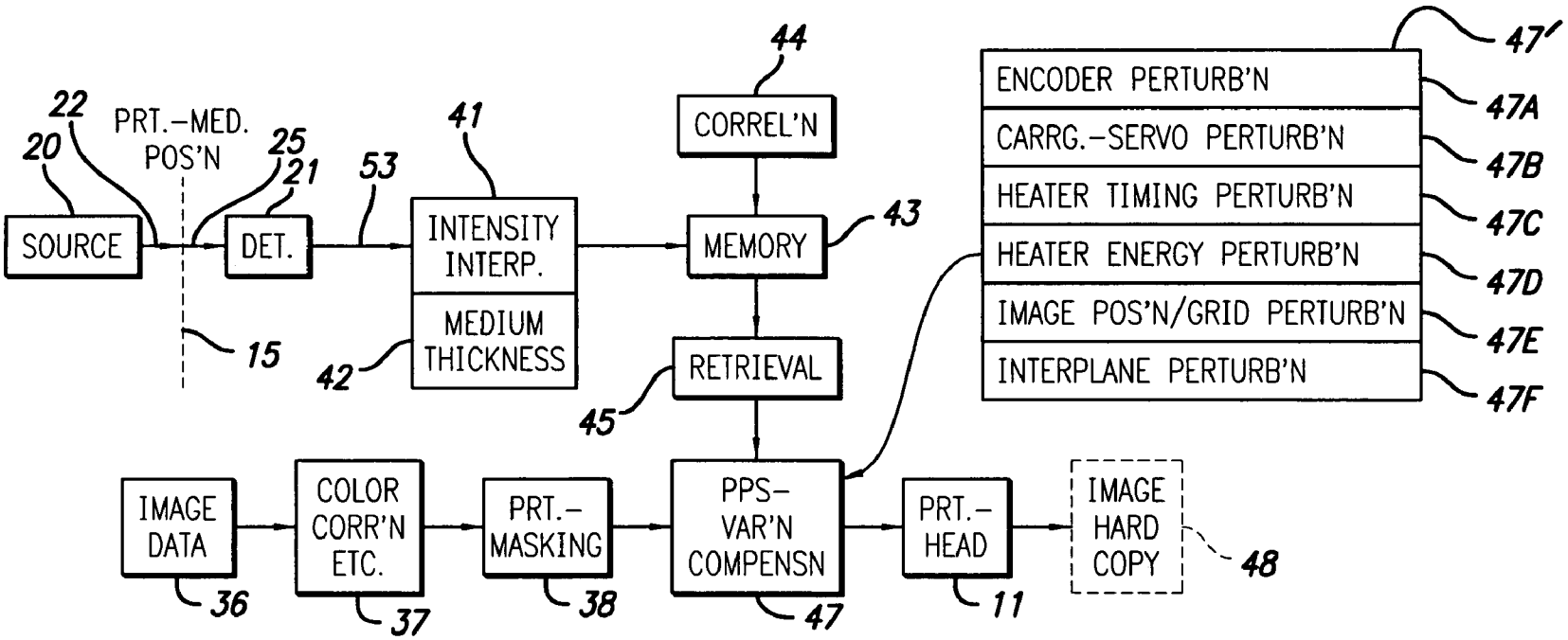
FIG. 6 is a block diagram illustrating a printer with PPS determination and compensation.

The nonprinting scan procedure of the present invention includes operating an illumination source 20 (FIG. 6). This source is advantageously though not necessarily a simple lamp such as an LED, small incandescent bulb etc. that emits substantially incoherent electromagnetic radiation in the visible, infrared or other preferred wavelength range.

The term "incoherent" is meant to distinguish a "laser sensor" such as suggested by Niikura, to the extent that his terminology designated a sensor system actually probing coherent radiation in e.g. an interferometric mode. Other propagating energy forms may be substituted as desired.

Radiation 22 from the source 20 is directed to the printing-medium position 15, and some radiation 25 reflected from that position is intercepted at a single-channel detector 21. The phrase "single channel" is meant to distinguish multichannel detectors such as Niikura's CCD.

While the radiation 22 is emitted, returned and collected, the source 20 and detector 21 (usually together with printheads to be used in marking, after the calibration is complete) are shifted by a mechanism 12, 13 (FIG. 4) that slides 17 generally parallel to the print-medium position 15. In principle the nonprinting scan procedure can be performed even with no printing medium at the printing-medium position 15 (FIG. 4), subject to later adjustment 42 (FIG. 6) for thickness t (FIG. 5) of printing medium then employed.

3. Optical Attenuation in Nonprinting Measurement

The source 20 and detector 21 are mounted with plural printheads 11 (FIGS. 4 and 5) on a carriage 12, which in turn operates along guide bars—only one bar 13 being shown—that extend parallel to the print-medium position. Truly rectilinear guide bars would conform to an undeviated locus 13", but in practice the guide bars are subject to deviations 13' from such rectilinearity—thus necessitating relative calibration procedures such as those of the present invention.

Figure 2:
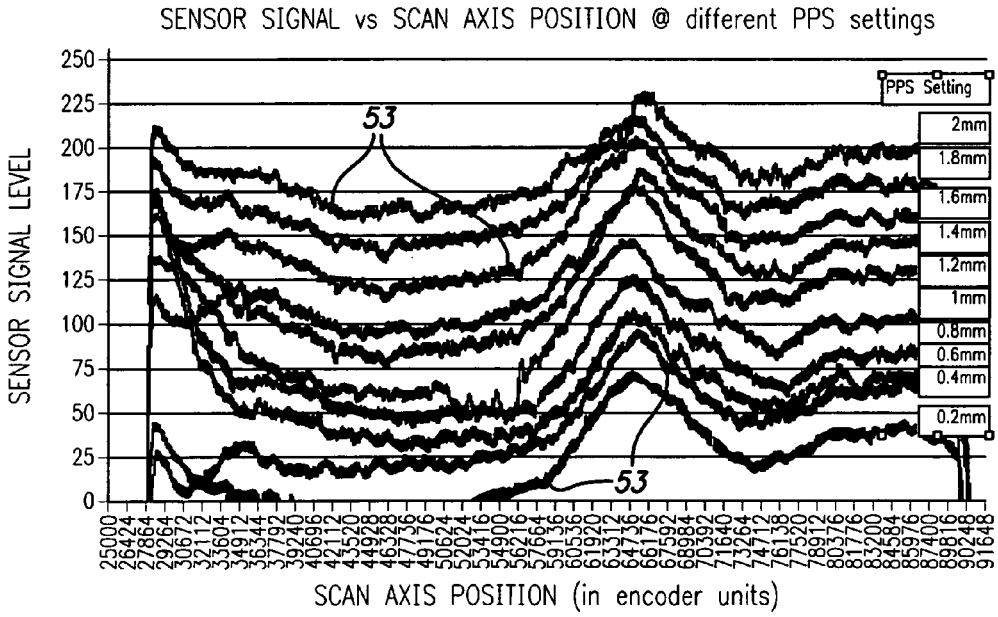
FIG. 2 is a reproduction of machine-recorded traces demonstrating responsiveness of sensor signals, in operation of the present invention, to PPS (in mm)—for an exemplary machine whose guide bar has a bump at 65,000 encoder counts.

As the heads 11, carriage 12, source 20 and detector 21 shift together along the bar 13, the detector 21 generates a signal 53 (FIGS. 2 and 6), varying in a very generally continuous way, that is related to the likewise varying overall transmission distance $d_1+d_2$ (FIG. 4) if no print medium is in position, or $d_3+d_4$ (FIG. 5) if a medium is present.

Radiation 22 from the source 20 may be partially collimated or confined, but as a general rule is neither well collimated nor coherent but rather simply expands into a rough beam envelope 23 having rough boundaries, diverging at some coarsely defined angle $\theta_1$. This is the character of the beam in its downward path through the distance $d_1$.

If the print-medium position 15 is defined by a polished surface 14'—e.g. of a platen 14—then reflection of the beam 22 may occur at that surface 14' and may be essentially specular. In this case the return beam 25 may have diverging properties generally similar to those of the initially projected beam 22, with a beam envelope 24 continuing to diverge at a roughly defined angle $\theta_2$ that is close to the previously mentioned divergence angle $\theta_1$ of the original beam 22.

If instead the platen surface 14' is only burnished or brushed, or is otherwise somewhat discontinuous or rough, then the reflection may be nonspecular—or may be specular but at multiple different facet angles, etc. In any such case the return beam 25 may have an envelope 26 that is much more roughly defined but in general diverges into a broader return angle $\theta_3$.

This is the character of the beam in its return path through a distance $d_2$. Depending on the effective "sight" or "field of view" angle $\theta_4$ of the detector 21—and also depending on whether it has a lens or window with optical power—greater or lesser fractions of this return beam 25 may reach the detector.

Whatever the intercepting sight angle $\theta_4$ may be, however, generally speaking the receiving aperture of the detector 21 cannot recover all the light 25, 24, 26 reflected from the platen 14—and the fraction that can be recovered falls with increasing distance $d_2$. Hence the signal generated in response by the detector likewise is a decreasing function of the return distance $d_2$.

This is the basis of the "attenuation" mentioned previously in the "SUMMARY OF THE DISCLOSURE" section of this present document. With a suitable adjustment for thickness t (FIG. 5) of a printing medium, the recovered fraction of the optical signal 25, 24, 26 serves as a measure of the PPS as it varies along the carriage path 17.

Because the attenuation mechanism is somewhat different along the forward leg $d_1$ and return leg $d_2$ of the transmission, the correlation 44 (FIG. 3) between signal level and PPS in many cases may not be a simple linear function in principle—and indeed some departures from a linear relation do appear clearly in the data. It is, however, reasonably orderly in practice and in any event reproducible enough for a useful calibration.

Figure 4:
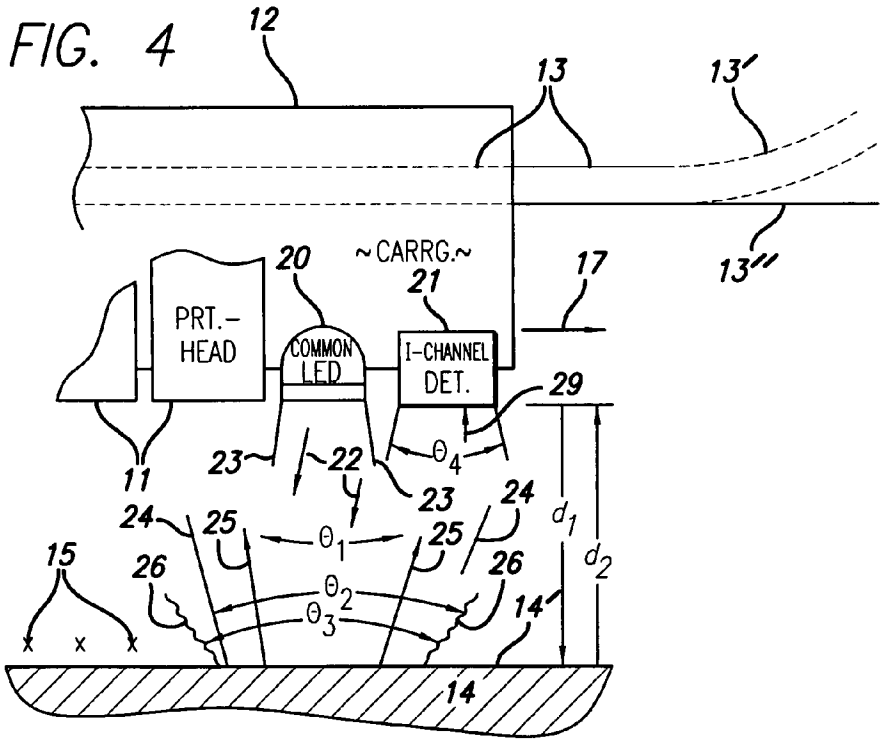
FIG. 4 is an elevational diagram like FIG. 1, but demonstrating how a primitive single-channel intensity sensor can respond to PPS variation—through relative attenuation of source illumination—even in the absence of a printing medium.

In fact, whether or not actually adjusted for print-medium thickness t, the return optical signal and resulting electronic signal from the detector 21 is a measure of the PPS. One valuable characteristic of the signal generated as suggested in FIG. 4 is that it is indeed independent of any printing medium that may later be used.

Hence such operation yields an accurate, reproducible profile of PPS as influenced by, exclusively, the mechanism 13, 13', 13". Thus this kind of operation can serve very well in place of the test-pattern-based methods presented in the earlier patent documents of Boleda.

The present invention, however, is not limited to obtaining return signals by reflection from the platen 14. Certain advantages accrue from operating the scan step with printing medium 16 (FIG. 5) in position.

Here the return beam characteristics may vary greatly, depending on the thickness, translucency and mechanical properties of the printing medium. For example if the medium is very smooth, dense and highly reflective at its surface, there may be relatively little beam penetration into the bulk of the material 16. In this case the system may operate very nearly as described above for FIG. 4—except that the reflecting surface is nearer to the source 20 and detector 21, and the transmission distances $d_3$, $d_4$ (FIG. 5) accordingly foreshortened relative to the corresponding distances $d_1$, $d_2$ (FIG. 4).

With a printing medium that presents a matte finish and is perhaps more porous, the beam 22 may penetrate the interior of the material 16 and may there be subject to many scattering reflections 31, 32 (FIG. 5) from particles or molecules of the medium. Many rays are likely to undergo multiple secondary reflections 33 before finally being reflected out of the medium at a considerable distance from their entry points (if they are not entirely dissipated within the material).

As a result of many such events, the response from a highly scattering print medium may be more in the nature of a relatively diffuse glow 34 than a well-defined beam. The fraction of illumination returned in this way that can be subtended by the aperture of the detector 21 and thus captured as a reflected beam 29' is strongly subject to attenuation with distance. Probably the correlation between PPS and intensity is higher in such a case than for the more nearly specular-reflecting materials (e.g. platen 14) discussed above.

Whether obtained with or without printing medium in place (FIGS. 5 and 4 respectively), the resulting data 53 can be used to measure PPS or mechanism error, or both. Only simple processing 41 is needed to develop an interpretation of the signal in terms of PPS, and where appropriate as explained above a correction for print-medium thickness 42 is readily made. Current data can be entered in a memory 43, and earlier correlations 44 can be drawn into the same memory device if desired.

When an image is to be printed, the printer receives input image data 36 as usual and performs conventional preliminary corrections 37 and printmasking 38 as is well known. The printmasked data then proceed to a stage 47 that retrieves 45 the massaged PPS data from the memory 43 and adjusts relative timing to compensate for the PPS variation.

This adjustment may be accomplished by perturbation 47 of the printing system at any one or more of several different earlier-mentioned points 47A–F. The compensation stage 47 then passes the adjusted data on to the final printing apparatus, especially the printheads 11, for marking of the hardcopy image 48 onto the print medium 16.

Figure 5:
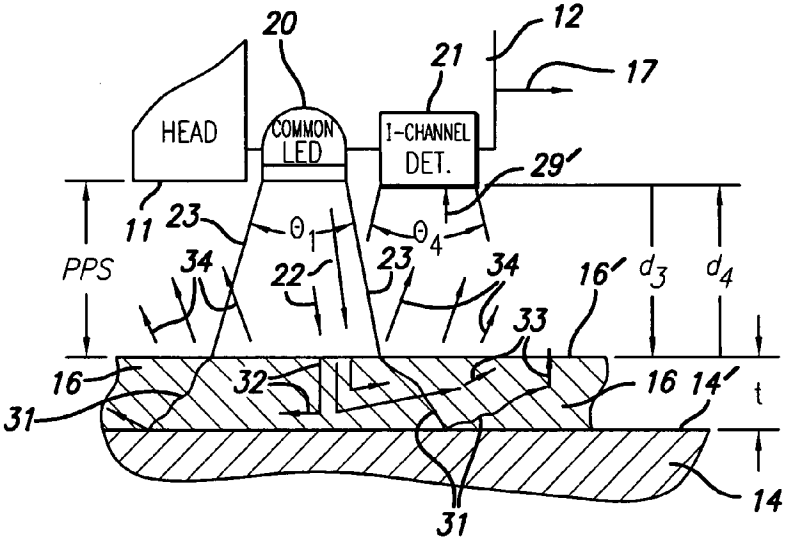
FIG. 5 is a diagram like FIG. 4 but demonstrating the same principle with a printing medium present.

It may be a question of semantics exactly what constitutes a "sensor" in a system such as shown in FIGS. 4 through 6. A sensor generally is taken as including a source 20 and a detector 21, with conventional power supplies and preamp (not shown), but raw data 53 from the detector 21 or even from an associated preamplifier may or may not be considered PPS information.

Hence a PPS sensor may be regarded as more complete if some additional blocks of those 41–45 in the system are also included. This discussion bears on whether the entire sensor, or only just portions of the sensor, are mounted on a scanning carriage.

In other words, the question is whether the sensor is fully mounted to the carriage or only partially mounted to the carriage. Certain of the appended claims are worded to encompass either approach to this question of definitions, by reciting that the sensor is "at least partially" mounted to the carriage.

Thus the sensor may be defined either as the source and detector, or those plus a preamp—or instead all of those plus the interpretive block 41, with or without the thickness adjustment stage 42, etc. For purposes of determining whether the appended claims read on some particular apparatus, it is intended that the claims do read on the apparatus if any of these definitions is satisfied. Additional variants generally within the claim entail a sensor that is sometimes parked but coupled to a scanning mechanism for use in sensing—analogous to the colorimeter taught in the above-mentioned Baker document.

4. Absolute P. P. S. with a Plural-Source Sensor

For absolute PPS measurements a detector can be provided with two or more sources, each perhaps inclined at a different angle to the print medium or other reflecting surface. Naturally such a system, like any other, is subject to measurement imprecision—but the measurements are "absolute" in the sense that they can be linked to an absolute value rather than only to a relative scale.

To facilitate obtaining such an output value in absolute terms, each partial-detector, in other words the detector operated with each of the plural sources considered one at a time, can be independently calibrated at a PPS design point of the printer. This phrase "PPS design point" here means the PPS setting for which the printer was designed, and at which its operation is nominal (and typically best).

After such independent calibration, the difference in signal levels obtained in operating the sensor with the different sources separately is a measure of the PPS distance from the design point. Theoretically absolute measurements could also be achieved by calibrating the design point of only one source—but using two or more, and measuring differences between the signals, should be a more robust method.

Figure 8:
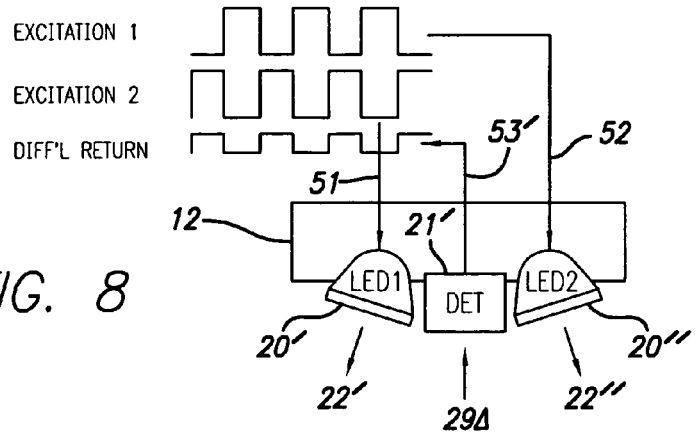
FIG. 8 is a partial elevational diagram like FIGS. 1, 4 and 5 but for a dual-source system such as used in FIG. 7—and also showing, superposed on the diagram, excitation signals for the two sources as well as a differential return signal from the single detector.

The sources may be two LEDs 20', 20" (FIG. 8), respectively emitting beams 22', 22"—optionally at different angles to the printing medium (not shown in FIG. 8). They are mounted as before on a common carriage 12 with the printheads (not shown in FIG. 8).

Part of the reason for the improvement is that a single-source approach may require relatively fine measurements of a relatively small signal variation on a sizable signal pedestal. When two or more signals are available, they can be differenced against one another electrically—as for example by synchronous detection, or more simply by sequencing the operation of the sources themselves and forming an a. c. composite.

The amplitude of that a. c. composite signal then is a direct measure of the actual PPS offset from the common design point that was assumed in calibrating the two partial-sensors. Since the design point is known, the offset is readily added or subtracted as appropriate to obtain a reliable value for the current system PPS.

Figure 7:
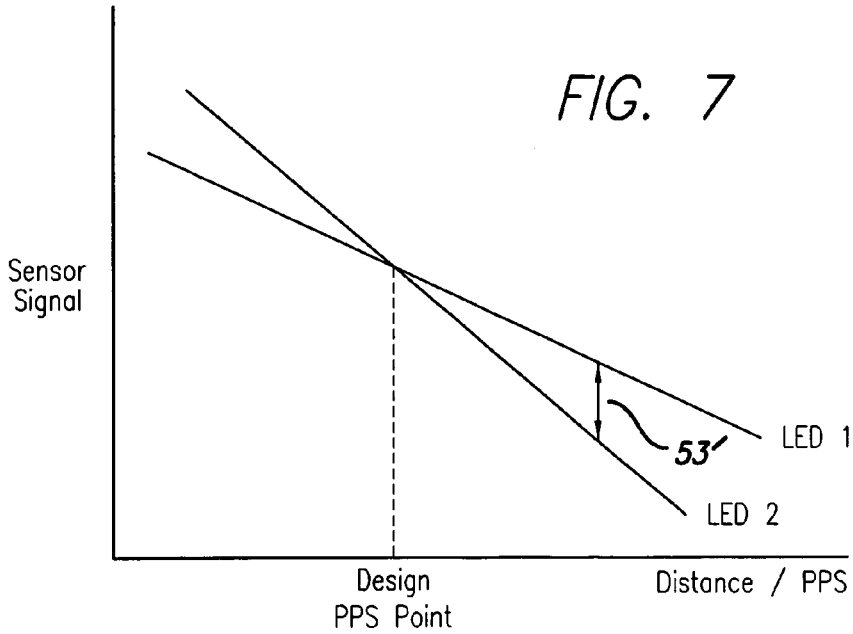
FIG. 7 is a graph of dual-source sensor responses as used in the above-introduced fourth main aspect of the invention.

Thus, returning to the FIG. 8 example, the two LEDs 20', 20" are driven by respective different waveforms 51, 52 that are opposed-phase square waves of equal magnitude as illustrated. The single detector 21' then receives an optical signal 29Δ that is a single, small-amplitude optical square wave representing the difference between the reflected components of the two emitted beams from 22', 22". The detector 21' responds with a like electronic square wave 53' (FIGS. 7 and 8) that is proportional to the PPS offset from the design value.

As with the previously discussed embodiments of the present invention, this one can be operated on a scanning basis to determine absolute PPS values all along the scan path. Such measurements can be beneficial in many ways, particularly by eliminating the need for expensive PPS tools on the manufacturing line—provided only that the sensor has two or more sources. In addition to fixture simplification, this approach saves time in the manufacturing process and thus further reduces cost.

5. Pagewide and Equivalent Applications

In these printer types, the printhead 111 (FIGS. 9 and 10) does not scan across the printing medium 16 but rather is stationary with respect to the platen or bed 114' of the machine. Conceptually the head 111 may form a bridge extending across the platen 114' between opposed print-medium guideways 131, 132.

Thus the provision of a scanning sensor 120/121 for checking PPS distance along the length of the printhead 111 must occur in the absence of several practical advantages found in a scanning printer. Those advantages include the preexisting carriage, with complete drive system and encoder, and even a preexisting line sensor provided on the carriage for other types of measurements.

In accordance with the invention nevertheless such a scanning sensor 120/121 can be added. It may be propelled in any of a great variety of ways, as for instance by a toothed endless belt 133 that is secured to the sensor and looped about a drive pulley 134 and idler 135. The drive pulley in turn may be operated by a stepping motor (or a motor and separate encoder) 136.

Formed in the underside of the head 111 are, typically, four or more rows 141–144 (FIG. 10) of ink-ejecting orifices, usually one row for each separate colorant to be provided in the machine. These colorants may be cyan, magenta, yellow and black inks—or as appropriate only the three chromatics, or all four plus light cyan and light magenta, etc.

Associated with the ejecting orifices are supply channels, electrical heaters, and conductors for controlling electrical firing pulses to the heaters. The heaters are controlled by microprocessors (not shown) to effectuate printing—including the needed timing compensations, as defined by the present invention, for PPS variation.

Although the sensor and its position-determining subsystem represents an added expense, at least the position determination can be far less precise than that employed in a typical scanning-printhead system. The PPS variation ordinarily is caused by relatively macroscopic phenomena and is accordingly much more coarse than the pixel-grid dimensions involved in printhead operation.

On the other hand, what must be maintained to a high degree of precision is alignment (or a known correction for known misalignment) between the sensor and the nozzles 141–144, in the direction of ink ejection. Ideally the ejecting face of the head 111 either is identically the guide track for the sensor 120/121, or is very closely interrelated with that track through intrinsic properties of the mechanical design.

Figure 9:
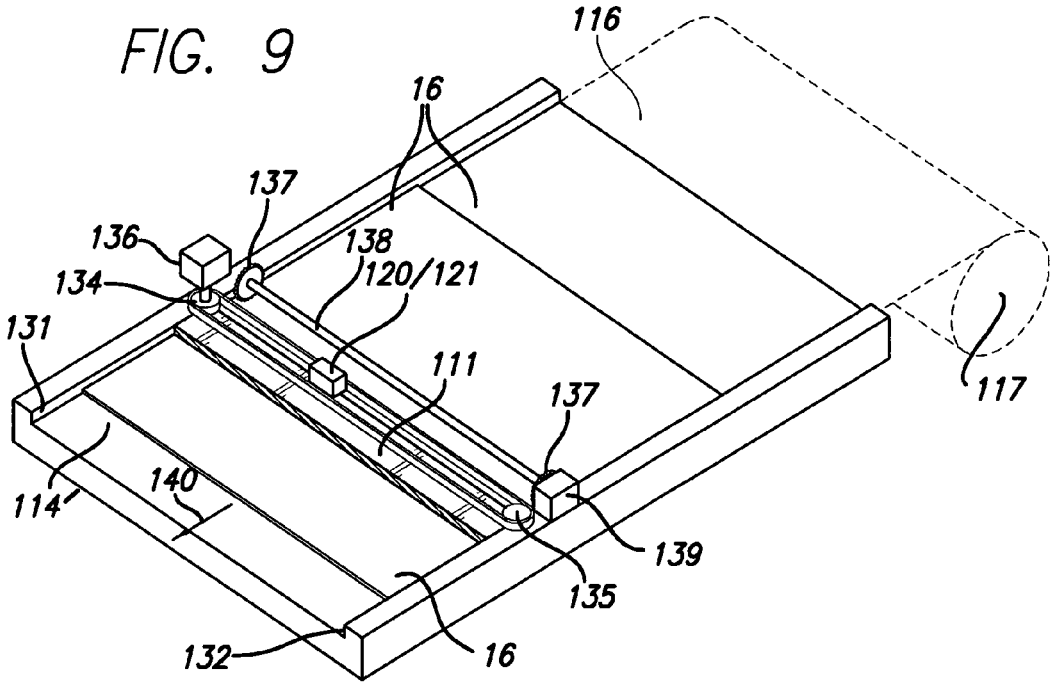
FIG. 9 is an isometric view, very highly schematic and conceptual, of the invention incorporated into a pagewide-array or equivalent webwide-array printing system.
Figure 10:
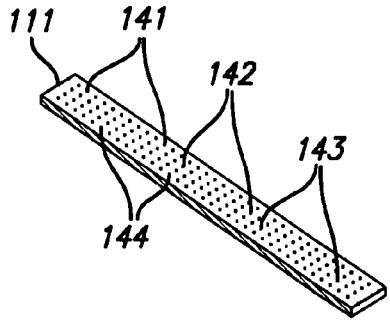
FIG. 10 is a bottom plan of a four-color marking head that is part of the FIG. 9 system.

PPS compensation in a system such as shown in FIG. 9 proceeds according to very generally the same protocol as in a scanning-head system. Perhaps the most important single difference is that the relative velocity which generates misregistration, when there is variation of PPS, is the lengthwise velocity of the printing medium 16 (or of the head 111 above it, in a stationary-medium flatbed system)—rather than the transverse velocity of a scanning head. Thus in the FIG. 9 system it is the lengthwise velocity of the medium 16 which comes into the calculation of the exact amount of firing advance or delay needed.

Toothed wheels 137 (typically cooperating with rollers, not shown, below the printing medium 16) drive the medium 16 in a longitudinal direction 140. The wheels are driven on a common axle 138 by a separate stepping motor 139. (Alternatively the system may drive only the rollers, or both the wheels and rollers.)

In a true pagewide-array system, as explained earlier, the medium itself is ordinarily in the form of a precut sheet or page 16 as indicated in the solid line in FIG. 9. An equivalent operation, with respect to the PPS monitoring capabilities of the present invention, entails instead feeding the printing medium as a continuous web 116 from a roll 117—as shown in the dashed line.

The printhead may thus be denominated either a "pagewide" or "webwide" array, respectively. In either case the motors 136, 139—like the nozzles 141–144—are actuated by processors (not shown) that operate preestablished programs for coordination of the printing and all other activities of the printer.

The above disclosure is intended as merely exemplary, and not to limit the scope of the invention—which is to be determined by reference to the appended claims.

What is claimed is:

1. Apparatus for printing images on a printing medium, by construction from individual marks; said apparatus being characterized by a design value for printhead-to-printing-medium spacing (PPS), and comprising:

printheads carried on a scanning carriage next to a printing-medium position;

a single-channel optical sensor having:

plural lamps emitting substantially incoherent light, means, including a photosensitive stage, for receiving and responding to the substantially incoherent light, and for developing therefrom a sensor output signal representing at least one difference between PPS measurements with a corresponding pair of the lamps;

said photosensitive stage being calibrated, with each of the plural lamps, at the design value of PPS; and means for interpreting the at least one difference signal as a PPS displacement from the design PPS value, to determine actual PPS in the printer.

2. The apparatus of claim 1, wherein:

the receiving and responding means comprise means for using the sensor with:

the pair of lamps in alternation to develop an a. c. signal output representing said at least one difference, and another pair of lamps in alternation to develop another a. c. signal output representing another difference;

the interpreting means comprise means for computing a mean of the differences; and the computing means comprise means for weighting the differences in an inverse relation to signal noise associated with each difference.

3. The apparatus of claim 1, further comprising:

means for applying a signal from the sensor to compute a profile of said PPS alone said scanning, using a known correlation function;

means for measuring intensity variations of reflected radiation received on the surface along said scanning;

means for interpreting the intensity variations as directly due to attenuation in travel of the radiation toward the printing-medium position and back;

means for retaining the interpreted intensity-variation information for use in compensating imperfection; and means for adjusting marking positions of the printheads, based on the computed PPS profile.

4. A method of compensating operation of a printer, which printer has printheads carried on a scanning carriage next to a printing-medium position; said method comprising the steps of:

scanning a surface substantially at the printing-medium position using a single-channel, plural-lamp optical sensor operating with substantially incoherent light;

defining a design value for printhead-to-printing-medium spacing in the printer;

calibrating the sensor, with each of plural lamps associated with the sensor, respectively, at the design PPS value;

installing the calibrated sensor in the printer;

operating the sensor, with each of the plural lamps respectively, in such a way as to develop a sensor output signal representing at least one difference between PPS measurements with a corresponding pair of the lamps; and interpreting the at least one difference signal as a PPS displacement from the design PPS value, to determine actual PPS in the printer.

5. The method of claim 4, wherein:

the operating step comprises using the sensor with:

the pair of lames in alternation to develop an a. c. signal output representing said at least one difference; and another pair of lamps in alternation to develop another a. c. signal output representing another difference;

the interpreting step comprises computing a mean of the differences; and the computing comprises weighting the differences in an inverse relation to signal noise associated with each difference.

6. The method of claim 4, further comprising the steps of:

applying a signal from the sensor to compute a profile of said PPS alone said scanning, using a known correlation function;

measuring intensity variations of reflected radiation received on the surface along said scanning;

interpreting the intensity variations as directly due to attenuation in travel of the radiation toward the printing-medium position and back;

retaining the interpreted intensity-variation information for use in compensating imperfection; and adjusting marking positions of the printheads, based on the computed PPS profile.

7. A method of compensating operation of a printer, which printer has printheads carried on a scanning carriage next to a printing-medium position; said method comprising the steps of:

scanning a surface substantially at the printing-medium position using a single-channel optical sensor operating with substantially incoherent light;

applying a signal from the sensor to compute a printhead-to-printing-medium spacing (PPS) profile along said scanning, using a known correlation function;

adjusting marking positions of the printheads, based on the computed PPS profile.

8. The method of claim 7:

further comprising the step of loading unprinted, bare printing medium into the printer; and wherein the surface-scanning step comprises scanning the unprinted, bare medium.

9. A method of calibrating a printer, which printer has printheads carried on a scanning carriage next to a printing-medium position, and has a carriage support-and-guide rod subject to imperfection in geometrical relation with the printing-medium position; said method comprising the steps of:

projecting radiation from the carriage toward the printing-medium position for reflection back toward the carriage, at plural locations of the carriage along the rod;

measuring intensity variations of reflected radiation received on the carriage at the plural locations;

interpreting the intensity variations as directly due to attenuation in travel of the radiation through the distance from the carriage toward the printing-medium position and back to the carriage; and retaining the interpreted intensity-variation information for use in compensating the imperfection.

10. The method of claim 9, wherein:

the projecting step comprises projecting the radiation to a printing medium disposed at the printing-medium position;

the measuring step comprises receiving the radiation reflected from the printing medium; and the attenuation is due to scattering of the radiation in the reflection, and divergence of the radiation during said travel.

11. The method of claim 10, wherein, during said projecting and receiving:

substantially nothing has been printed on the printing medium;

whereby the printing medium is substantially bare printing medium.

12. The method of claim 9, wherein:

the projecting step comprises projecting the radiation to a platen disposed substantially at the printing-medium position; and the measuring step comprises receiving the radiation reflected from the platen.

13. The method of claim 12, wherein:

the interpreting step comprises making a distance allowance for thickness of printing medium absent from the platen.

14. The method of claim 9, wherein:

the interpreting step comprises referring to a previously determined correlation function between intensity variation information and printhead-to-printing-medium spacing.

15. A method of determining printhead-to-printing-medium spacing (PPS) in an incremental printer, using a plural-lamp sensor; said method comprising the steps of:

defining a design value for PPS in the printer;

calibrating the sensor, with each lamp of the plurality respectively, at the design PPS value;

installing the calibrated sensor in the printer;

operating the sensor, with each lamp of the plurality respectively, in such a way as to develop a sensor output signal representing at least one difference between PPS measurements with a corresponding pair of the lamps; and interpreting the at least one difference signal as a PPS displacement from the design PPS value, to determine actual PPS in the printer.

16. The method of claim 15, wherein the operating step comprises:

using the sensor with the pair of lamps in alternation to develop an a. c. signal output representing said at least one difference.

17. The method of claim 16, wherein:

the operating step further comprises using the sensor with another pair of lamps in alternation to develop another a. c. signal output representing another difference; and the interpreting step comprises computing a mean of the differences.

18. The method of claim 17, wherein:

the computing comprises weighting the differences in an inverse relation to signal noise associated with each difference.

19. The method of claim 18, wherein:

the computing comprises finding said mean as a root-mean-square of the weighted differences.

20. Apparatus for printing an image on a printing medium, by construction from individual marks; said apparatus comprising:

a platen locating such medium;

an array of printing elements marking on such medium, said array being of length at least as great as width of such image;

an advance mechanism providing relative motion of such medium and the array, substantially at right angles to the array length;

a carriage scanning lengthwise along the array;

a sensor, at least partially mounted to the carriage, measuring relative distances between the sensor and the platen or such medium; said sensor comprising first processor portions interpreting intensity of reflected radiation, at each of plural positions along the scanning motion respectively, as a measure of respective transmission distances from a source to the sensor via reflection from the platen or such medium; and second microprocessor portions modifying the marking by the array to compensate for variation of the measured distances along the array length.

21. The apparatus of claim 20, wherein:

the carriage carries exclusively the sensor or portions thereof, not the array.

* * * * *

UNITED STATES PATENT AND TRADEMARK OFFICE

CERTIFICATE OF CORRECTION

PATENT NO. : 7,156,482 B2
APPLICATION NO. : 09/942070
DATED : January 2, 2007
INVENTOR(S) : Miquel Boleda et al.

It is certified that error appears in the above-identified patent and that said Letters Patent is hereby corrected as shown below:

On the title page, item (73), in "Assignee", in column 1, line 1, delete "Hewlett Packard" and insert -- Hewlett-Packard --, therefor.

In column 1, line 22, after "Pat. No." delete "5.".

In column 1, line 26, after "Pat. No." delete "5.".

In column 16, line 35, in Claim 3, delete "alone" and insert -- along --, therefor.

In column 17, line 3, in Claim 5, delete "lames" and insert -- lamps --, therefor.

In column 17, line 14, in Claim 6, delete "alone" and insert -- along --, therefor.

Signed and Sealed this

Eleventh Day of November, 2008

JON W. DUDAS
*Director of the United States Patent and Trademark Office*